US008820905B2

(12) United States Patent
Kobayashi et al.

(10) Patent No.: US 8,820,905 B2
(45) Date of Patent: Sep. 2, 2014

(54) LIQUID EJECTING HEAD AND LIQUID EJECTING APPARATUS

(75) Inventors: Hiroyuki Kobayashi, Shiojiri (JP); Munehide Kanaya, Azumino (JP); Katsuhiro Okubo, Azumino (JP); Nobuyoshi Uji, Tatsuno-machi (JP); Kazuhide Nakamura, Asahi-mura (JP)

(73) Assignee: Seiko Epson Corporation, Tokyo (JP)

( * ) Notice: Subject to any disclaimer, the term of this patent is extended or adjusted under 35 U.S.C. 154(b) by 365 days.

(21) Appl. No.: 13/010,218

(22) Filed: Jan. 20, 2011

(65) Prior Publication Data

US 2011/0228021 A1 Sep. 22, 2011

(30) Foreign Application Priority Data

Mar. 19, 2010 (JP) ..... 2010-065279

(51) Int. Cl.
*B41J 2/175* (2006.01)
*B41J 2/14* (2006.01)

(52) U.S. Cl.
CPC .... *B41J 2/14233* (2013.01); *B41J 2002/14362* (2013.01); *B41J 2002/14403* (2013.01)
USPC ..... 347/93; 347/65; 347/84

(58) Field of Classification Search
None
See application file for complete search history.

(56) References Cited

U.S. PATENT DOCUMENTS

| | | | | |
|---|---|---|---|---|
| 5,900,898 | A * | 5/1999 | Shimizu et al. | 347/93 |
| 6,019,465 | A * | 2/2000 | Shinada et al. | 347/93 |
| 6,158,855 | A * | 12/2000 | Saikawa | 347/93 |
| 6,814,435 | B1 * | 11/2004 | Shimada et al. | 347/93 |
| 7,922,311 | B2 * | 4/2011 | Chikamoto et al. | 347/93 |
| 2002/0012034 | A1 * | 1/2002 | Saikawa | 347/93 |
| 2004/0257414 | A1 * | 12/2004 | Anderson et al. | 347/93 |
| 2009/0212460 | A1 | 8/2009 | Kamikura | |
| 2009/0213199 | A1 | 8/2009 | Owaki et al. | |

FOREIGN PATENT DOCUMENTS

| | | |
|---|---|---|
| CN | 1982065 | 6/2007 |
| JP | 2000-141697 | 5/2000 |
| JP | 2006-069168 | 3/2006 |
| JP | 2006-326900 | 12/2006 |
| JP | 2009-196224 | 9/2009 |
| JP | 2009-220567 | 10/2009 |

* cited by examiner

*Primary Examiner* — Manish S Shah
*Assistant Examiner* — Yaovi Ameh
(74) *Attorney, Agent, or Firm* — Workman Nydegger

(57) ABSTRACT

A liquid ejecting head includes: a head body which ejects a liquid supplied from a liquid storing member via a liquid supply path; a first supply member which is provided with a first liquid supply path forming a part of the liquid supply path; a second supply member which is provided with a second liquid supply path communicating with the first liquid supply path and forming a part of the liquid supply path, and which supplies the liquid to the head body; and a filter which is sandwiched between the first and second liquid supply paths, wherein a sandwiching portion including the first and second supply members and sandwiching the filter includes an inclination portion that is inclined to the downstream side so as to face the outside of the liquid supply path. A liquid ejecting apparatus includes the liquid ejecting head.

8 Claims, 8 Drawing Sheets

LIQUID EJECTING HEAD AND LIQUID EJECTING APPARATUS

The entire disclosure of Japanese Patent Application No: 2010-065279, filed Mar. 19, 2010 are expressly incorporated by reference herein.

BACKGROUND

1. Technical Field

The present invention relates to a liquid ejecting head and a liquid ejecting apparatus ejecting a liquid, and particularly, to an ink jet printing head and an ink jet printing apparatus ejecting ink as a liquid.

2. Related Art

In an ink jet printing head as a representative example of a liquid ejecting head, ink is supplied from an ink cartridge as a liquid storing member filled with the ink to a head body via an ink supply needle which is attachably or detachably inserted to the ink cartridge or disposed at a front end of a supply tube such as a tube extending from the ink cartridge, and an ink supply path which is formed in a supply member such as a cartridge casing holding the ink cartridge. Then, a pressure generating member such as a piezoelectric element provided in the head body is driven so as to eject the ink, supplied to the head body, from a nozzle.

In such an ink jet printing head, a configuration is known in which a filter used for removing bubbles or sediments contained in the ink is disposed between the cartridge casing and the ink supply needle inserted into the ink cartridge in order to solve ejection errors, such as dot skipping, caused by bubbles or the like (for example, refer to JP-A-2009-220567).

However, in the configuration disclosed in JP-A-2009-220567, the filter, the cartridge casing, or the like may be deformed by heat or the like generated during the integral molding process. In this case, when the filter is deformed and depressed toward the inner wall surface of the channel on the downstream side of the filter, the filter may adhere to the inner wall surface or the deformed filter may block the channel during a cleaning process of performing a bubble discharging operation in which suction is performed through a large negative pressure, which causes a problem in that the bubble discharging performance is degraded. Further, there is a problem in that the filter is twisted to adhere to the inner wall surface of the channel on the downstream side of the filter or bubbles tend to assemble between the twisted filter and the inner wall surface of the channel or the like on the downstream side of the filter.

Further, these problems occur not only in the ink jet printing head, but also in a liquid ejecting head ejecting liquids other than ink.

SUMMARY

An advantage of some aspects of the invention is that it provides a liquid ejecting head capable of suppressing a degradation of bubble discharging performance and a liquid ejecting apparatus capable of exhibiting desired liquid ejecting characteristics by using the liquid ejecting head.

According to an aspect of the invention, provided is a liquid ejecting head including: a head body which ejects a liquid supplied from a liquid storing member via a liquid supply path; a first supply member which is provided with a first liquid supply path forming a part of the liquid supply path; a second supply member which is provided with a second liquid supply path communicating with the first liquid supply path and forming a part of the liquid supply path, and which supplies the liquid to the head body; a filter which is sandwiched between the first and second liquid supply paths; and an integral molding portion which integrally molds and bonds the first and second supply members to each other, wherein a sandwiching portion including the first and second supply members and sandwiching the filter includes an inclination portion that is inclined to the downstream side so as to face the outside of the liquid supply path.

With such a configuration, the sandwiching portion including the first and second supply members and sandwiching the filter includes the inclination portion that is inclined to the downstream side so as to face the outside of the liquid supply path. Accordingly, in the liquid ejecting head of the aspect, it is possible to allow the filter to protrude toward the first liquid supply path, and thus to suppress a degradation of the bubble discharging performance by preventing the filter from being deformed toward the inner wall surface of the second liquid supply path. In addition, since a gap between the filter and the inner wall surface is not narrowed, it is possible to supply a sufficient amount of liquid to bubbles that tend to stay at the position therebetween. Therefore, bubbles tend not to assemble around the circumference of the channel area of the filter.

The filter may include a channel area and a sandwiching area sandwiched by the first and second supply members. An inner wall surface facing the channel area in the second liquid supply path may be provided with a protrusion member that protrudes toward the first liquid supply path. Accordingly, since the filter can be supported by the protrusion member even when the filter is depressed toward the second liquid supply path, it is possible to suppress a degradation of the bubble discharging performance.

Here, the protrusion member may protrude toward the first liquid supply path past a surface sandwiching the filter. Since the filter protrudes toward the first liquid supply path and the protrusion state is easily maintained, it is possible to suppress a degradation of the bubble discharging performance.

Further, an inner wall surface facing the channel area in the first liquid supply path may be provided with a regulation member that protrudes toward the filter and regulates the filter from the upstream side. Since the regulation member is provided, it is possible to prevent the filter from being excessively deformed toward the first liquid supply path.

The distance between a surface facing a surface sandwiching the filter in the second liquid supply path, and the surface sandwiching the filter may be uniform. With such a configuration, even when the filter is deformed toward the first liquid supply path, it is possible to maintain the flow rate of the ink.

A liquid ejecting apparatus includes the liquid ejecting head. Since the liquid ejecting head suppressing a degradation of the bubble discharging performance is provided, it is possible to obtain desired liquid ejecting characteristics.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail with reference to the exemplary embodiments.

First Embodiment

Figure 1:
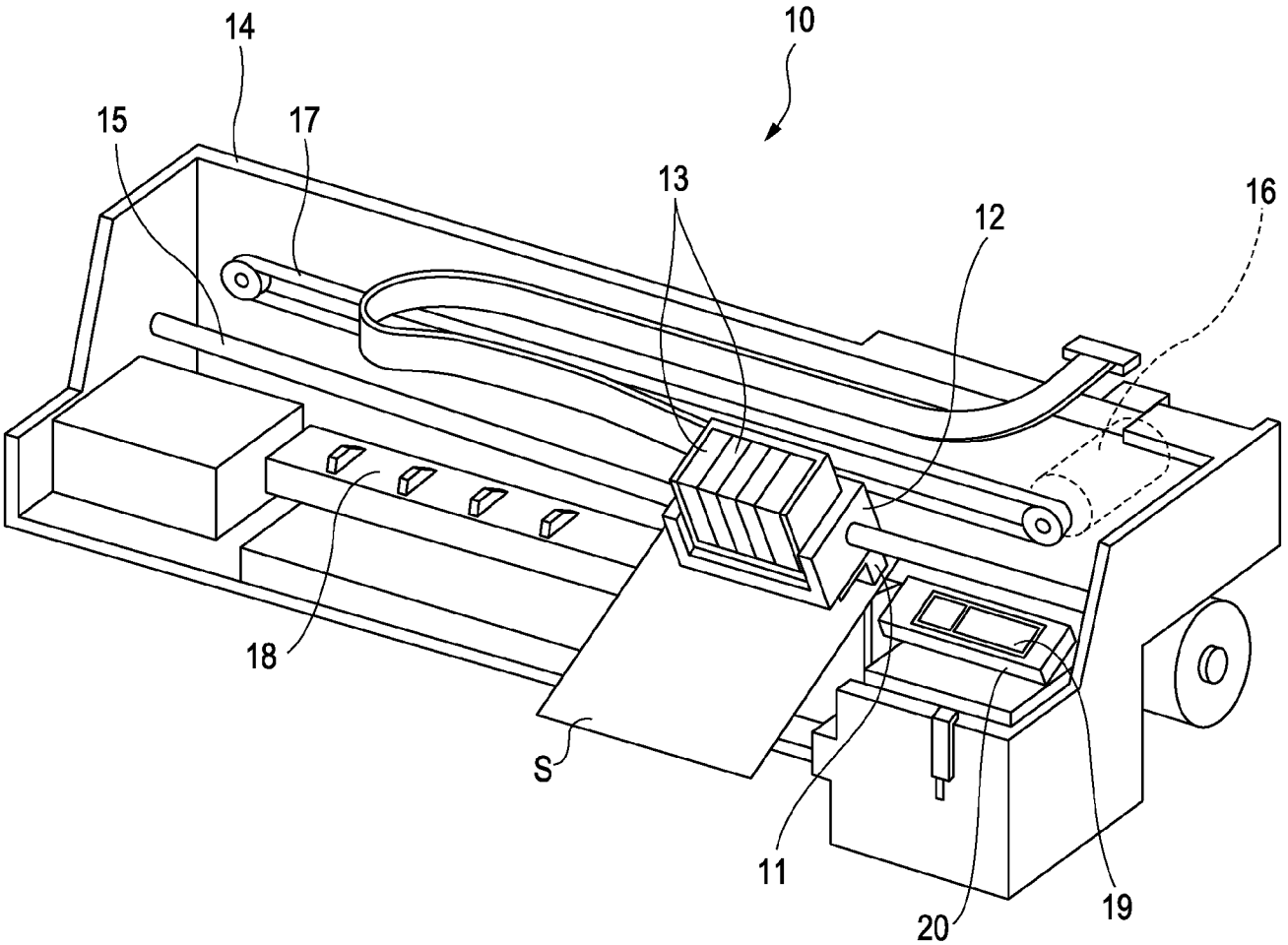
FIG. 1 is a schematic perspective view illustrating a printing apparatus according to a first embodiment.

FIG. 1 is a schematic perspective view illustrating an ink jet printing apparatus which is an example of a liquid ejecting apparatus according to a first embodiment of the invention. As shown in FIG. 1, an ink jet printing apparatus 10 of the invention has a configuration in which an ink jet printing head (hereinafter, referred to as a printing head) 11 as an example of a liquid ejecting head ejecting an ink droplet is fixed to a carriage 12, and an ink cartridge 13 as an example of a liquid storing member storing plural inks having different colors such as black (B), light black (LB), cyan (C), magenta (M), and yellow (Y) are attachably/detachably fixed to the printing head 11.

The carriage 12 having the printing head 11 mounted thereon is provided in a carriage shaft 15 attached to an apparatus body 14 so as to be movable in the axial direction. Then, when a driving force of a driving motor 16 is transmitted to the carriage 12 via plural gears (not shown) and a timing belt 17, the carriage 12 moves along the carriage shaft 15. On the other hand, a platen 18 is provided in the apparatus body 14 so as to follow the shaft 15, and a printing target medium S such as a sheet fed by a sheet feeding device (not shown) or the like is transported onto the platen 18.

Further, a position corresponding to a home position of the carriage 12, that is, the vicinity of one end portion of the carriage shaft 15 is provided with a capping device 20 that includes a cap member 19 sealing a nozzle formation surface of the printing head 11. The nozzle formation surface having nozzle openings formed thereon is sealed by the cap member 19, thereby preventing the ink from being dried. Further, the cap member 19 serves as an ink receiver during a flushing operation.

Figure 2:
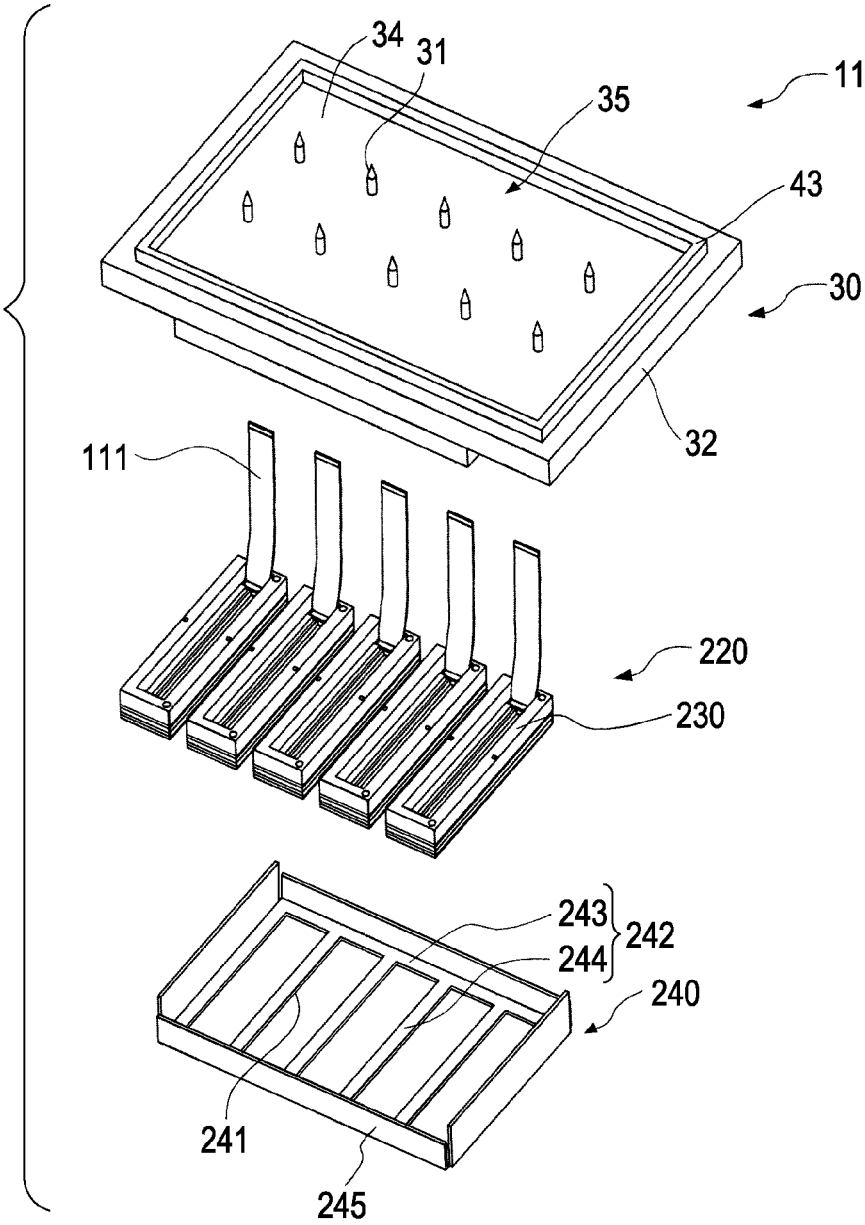
FIG. 2 is an exploded perspective view illustrating a printing head according to the first embodiment.

As shown in FIG. 2, the printing head 11 includes: a supply member 30 such as plural ink supply needles 31 (first supply members) inserted into the ink cartridge 13 as a liquid storing member or a cartridge casing 32 (second supply member) having the ink cartridge 13 fixed thereto; a head body 220 fixed to the surface opposite to the ink cartridge 13 in the supply member 30; and a cover head 240 provided on a liquid ejection surface of the head body 220.

Figure 3:
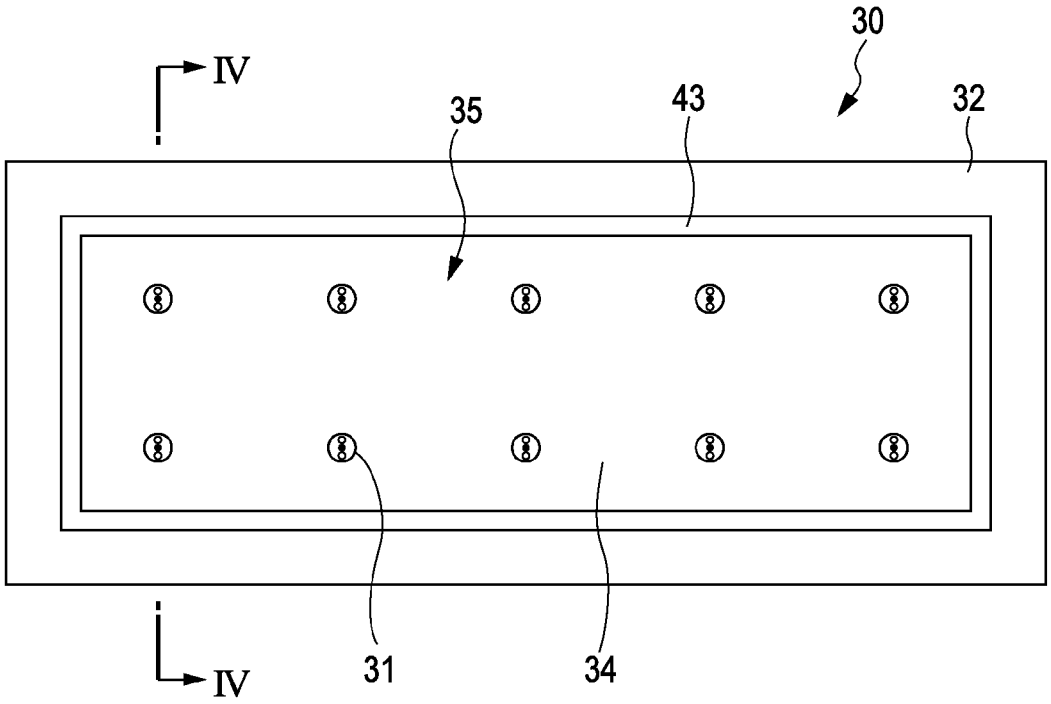
FIG. 3 is a top view illustrating a supply member according to the first embodiment.
Figure 4:
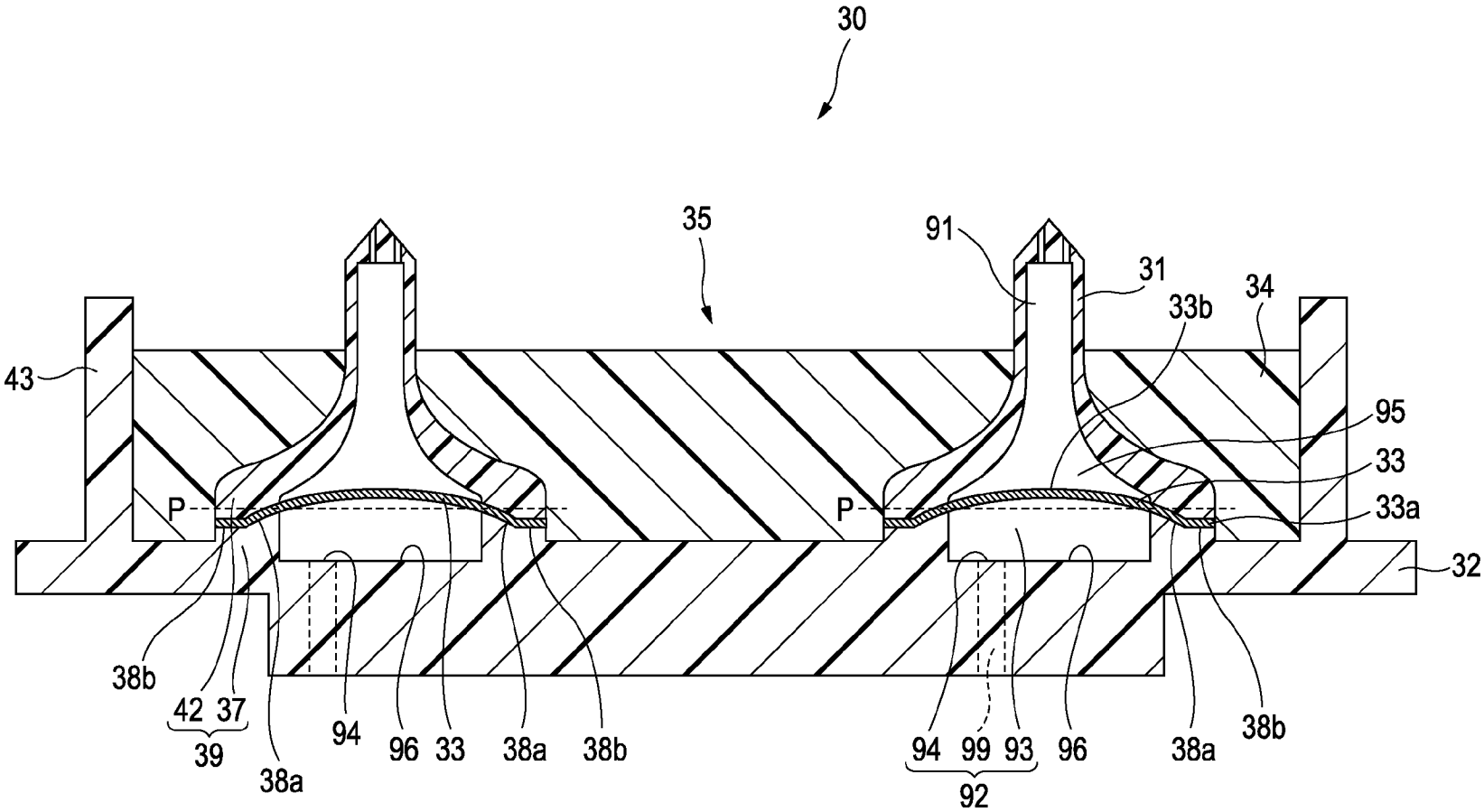
FIG. 4 is a cross-sectional view illustrating a cartridge casing according to the first embodiment.

First, the supply member 30 will be described in detail. As shown in FIG. 3 corresponding to the plan view of the supply member 30 and FIG. 4 corresponding to the cross-sectional view taken along the line IV-IV of FIG. 3, the cartridge casing 32 constituting the supply member 30 includes a cartridge attachment portion 35 to which the ink cartridge 13 is attached. In addition, the cartridge casing 32 is provided with a second ink supply path 92 (a second liquid supply path) of which one end is opened from the cartridge attachment portion 35 and the other end is opened from the head body 220. Then, as shown in FIG. 4, the second ink supply path 92 includes a filter chamber 93 which is formed from the ink supply needle 31 so as to have the same inner diameter, and a communication supply path 99 which communicates with the filter chamber 93 via an opening portion 94 (a liquid supply opening) as an opening portion on the side of the head body 220 in the filter chamber 93 and communicates with the head body 220.

Further, the ink supply needle 31 is fixed to the opening portion of the second ink supply path 92 of the cartridge attachment portion 35 of the cartridge casing 32 via a filter 33. The ink supply needle 31 is provided with a first ink supply path 91 (a first liquid supply path) of which one end is opened from the cartridge casing 32 and the other end is opened from the ink cartridge 13. Then, the first ink supply path 91 includes a large width portion 95 of which the inner diameter gradually decreases from the cartridge casing 32. Further, the first ink supply path 91 communicates with the second ink supply path 92, and form a part of the ink supply path (the liquid supply path) connecting the ink cartridge 13 and the head body 220 to each other.

Then, the cartridge casing 32 and the ink supply needle 31 includes a sandwiching portion 39 which is an area sandwiching the filter 33. In the embodiment, the sandwiching portion 39 includes: a filter sandwiching portion 37 which is provided in the opening edge portion on the side of the cartridge attachment portion 35 of the second ink supply path 92 of the cartridge casing 32; and a needle side filter sandwiching portion 42 which is provided in the opening edge portion on the side of the cartridge casing 32 of the ink supply needle 31 so as to face the filter sandwiching portion 37. Specifically, the sandwiching portion 39 has a configuration in which an inclination portion **38*a* to be described later is formed on the side of the second ink supply path 92, and a flat portion 38*b* is formed on the outside of the inclination portion 38*a***.

Further, the filter 33 is formed by minutely woven metals so as to have a sheet shape with plural minute holes formed therein. Since the filter 33 is sandwiched by the sandwiching portion 39 including the filter sandwiching portion 37 and the needle side filter sandwiching portion 42, the filter 33 is provided between the first ink supply path 91 provided in the ink supply needle 31 and the second ink supply path 92 provided in the cartridge casing 32. That is, the filter 33 includes a sandwiching area **33*a* which is sandwiched by the sandwiching portion 39 and an area which is not sandwiched by the sandwiching portion 39, that is, a channel area 33*b* which is exposed to the first ink supply path 91 and the second ink supply path 92 (hereinafter, referred to as an ink channel). Bubbles or foreign substances contained in the ink are removed by the filter 33**.

Then, in the invention, the supply member 30 includes an integral molding portion 34 that integrates the cartridge casing 32, the ink supply needle 31, and the filter 33. The integral molding portion 34 is formed by integrally molding and bonding the cartridge casing 32 and the ink supply needle 31 sandwiching the filter 33. Here, the integral molding and bonding indicates that the ink cartridge 32 and the ink supply needle 31 are bonded to each other without using ultrasonic welding or the like by molding the integral molding portion 34 so as to contact both the cartridge casing 32 and the ink supply needle 31. Further, in the embodiment, a protruding wall portion 43 is formed on the surface having the ink supply needle 31 fixed thereto in the cartridge casing 32, and the integral molding portion 34 formed in the manufacturing process to be described later is provided on the inside of the wall portion 43.

Likewise, since the cartridge casing 32 and the ink supply needle 31 are integrally molded and bonded, it is possible to decrease the size of the printing head 11. Specifically, when the cartridge casing 32 and the ink supply needle 31 are not integrally molded and bonded, the filter 33 is welded to the cartridge casing 32 by thermal welding or the like, and the ink supply needle 31 is welded to the filter by ultrasonic welding or the like. In this case, an area for welding the filter 33 needs to be provided in the cartridge casing 32, and an area for welding the ink supply needle 31 needs to be provided on the outside of the area. On the other hand, in the invention, since the cartridge casing 32 and the ink supply needle 31 are fixed by the integral molding portion 34, the area for the welding is not needed. Accordingly, it is possible to shorten a gap between the adjacent ink supply needles 31, and to decrease the size of the printing head 11. Further, in the invention, since a decrease in the size of the printing head can be realized, it is not necessary to decrease the size of the printing head 11 by decreasing the area of the filter 33. Accordingly, it is not necessary to excessively decrease the area of the filter 33, and to increase the driving voltage driving a pressure generator such as a piezoelectric element 300 or a heating element.

However, when the cartridge casing 32 and the ink supply needle 31 are fixed by the integral molding portion 34, in the related art, the filter is bent by thermal contraction after the integral molding and bonding, and the filter is depressed downward more than a plane (a sandwiching surface of the filter 33) including the edge portion of the filter 33 sandwiched between the filter sandwiching portion 37 and the needle side filter sandwiching portion 42, that is, a bonding plane P (hereinafter, simply referred to as a bonding plane P) between the ink supply needle 31 and the cartridge casing 32. As a result, the filter adheres to the inner wall surface or blocks the channel when bubbles are discharged, which raises a problem that the bubble discharging performance is degraded.

Therefore, in the embodiment, the sandwiching portion 39 includes the inclination portion 38*a* which is formed on the side of the ink channel so as to be inclined downward (toward the downstream side) from the ink channel side to the outside thereof. Accordingly, the filter 33 sandwiched at the inclination portion 38*a* is inclined in accordance with the inclination of the inclination portion 38*a* so as to protrude toward the ink supply needle 31 more than the bonding plane P. Specifically, the sandwiching area 33*a* of the filter 33 is sandwiched by the sandwiching portion 39 in an inclined state, and the filter 33 is contracted when the molding is performed in this state. Accordingly, the filter 33 is formed in a curved surface shape which is gently inclined so that the center thereof protrudes the most toward the ink supply needle 31. That is, in the embodiment, since the filter 33 can protrude toward the ink supply needle 31 more than the bonding plane P by providing the inclination portion 38*a* in the sandwiching portion 39, it is possible to obtain a large distance between the inner wall surface 96 and the peripheral portion of the channel area 33*b* of the filter 33. As a result, in the embodiment, it is possible to prevent the filter 33 from being deformed toward the inner wall surface 96. Accordingly, since it is possible to prevent the filter 33 from adhering to the inner wall surface 96 and to prevent the channel from being blocked during the bubble discharging operation, it is possible to suppress the bubble discharging performance from being degraded. Further, since it is possible to prevent the filter 33 from being deformed toward the inner wall surface 96, it is possible to prevent bubbles from easily assembling between the filter 33 and the inner wall surface 96.

Figure 5:
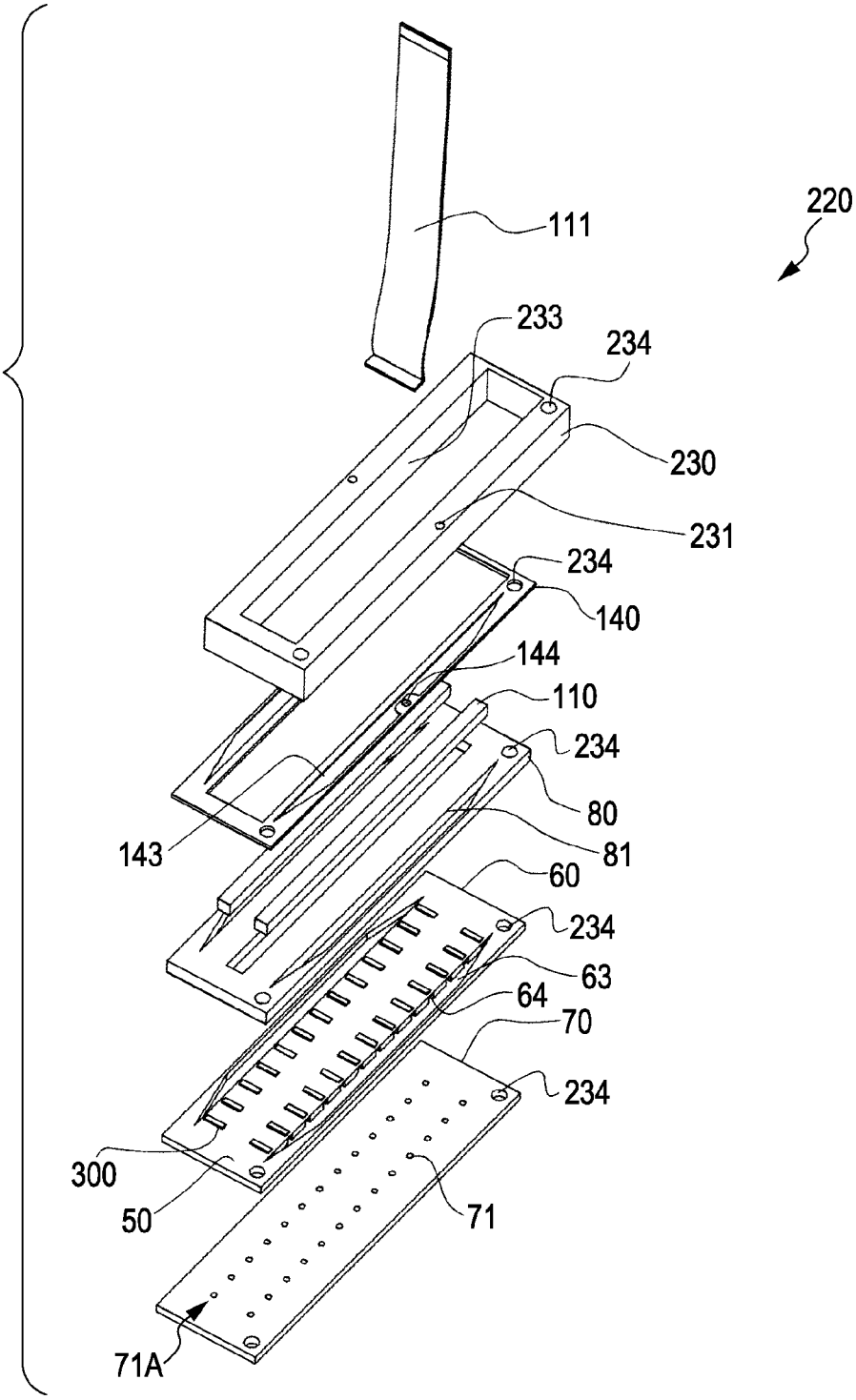
FIG. 5 is an exploded perspective view illustrating a head body according to the first embodiment.

Further, when the filter 33 is formed in a convex shape toward the ink supply needle 31 as in the embodiment, it is possible to improve bubble discharging performance during a cleaning operation (a bubble discharging operation) of suctioning the ink from a nozzle opening 71 (refer to FIG. 5). That is, in the case of the bubble discharging operation, it is possible to easily discharge bubbles when the bubbles are collected at one position to thereby form one bubble. In the embodiment, since the center portion of the filter 33 is formed in a convex shape, the bubbles staying on the downstream side of the filter 33 tend to assemble at the convex area. Accordingly, it is possible to improve the bubble discharging performance compared with the case where a flat filter is used.

Furthermore, in the embodiment, since the filter 33 is formed in a convex shape toward the ink supply needle 31, the flow rate decreases compared with the case where the filter 33 is flat. For this reason, it is necessary to prevent the flow rate from decreasing. Therefore, in the embodiment, the inner diameter of the filter chamber 93 is formed to be constant, that is, the inner wall surface 96 of the filter chamber 93 is formed to have a flat bottom surface portion. Likewise, since the inner diameter of the filter chamber 93 is constant, it is possible to prevent the flow rate from decreasing, and to widen the distance between the filter 33 and the inner wall surface 96. Accordingly, it is possible to prevent the filter 33 from adhering to the inner wall surface 96 during the bubble discharging operation.

Likewise, even when the filter 33 is formed in a convex shape, if the filter 33 is sandwiched in an inclined state at the sandwiching portion 39, it is possible to simply form the entire filter 33 in a convex shape toward the ink supply needle 31. For example, a method may be supposed in which the filter 33 protrudes toward the ink supply needle by providing one protrusion member in the inner wall surface 96 so as to protrude more than the bonding plane P and not to disturb the flow of the ink. However, it is necessary to set the size of the protrusion member so as to have an appropriate distance between the filter and the inner wall surface in consideration of a degree that the filter is pushed up by one protrusion member. For this reason, it is desirable that the filter 33 is curved by the inclination portion 38*a* so as to protrude toward the ink supply needle 31 as in the embodiment.

Further, in the integral molding and bonding, it is not possible to determine whether the filter 33 is deformed on the basis of its appearance, and it is necessary to check the deformation of the filter 33 on the basis of the breakage or the like of the member provided with the filter 33. However, in the embodiment, since the filter 33 protrudes toward the ink supply needle 31 by providing the inclination portion 38*a* in the sandwiching portion 39, it is not necessary to check whether the filter 33 is deformed toward the inner wall surface 96 on the basis of the breakage or the like of the member provided with the filter 33.

For example, the above-described ink jet printing head 11 and, in particular, the supply member 30 are manufactured as below.

The filter 33 is disposed between the needle side filter sandwiching portion 42 of the ink supply needle 31 and the filter sandwiching portion 37 of the cartridge casing 32. In this case, since the sandwiching portion 39 of the filter sandwiching portion 37 and the needle side filter sandwiching portion 42 includes the flat portion 38*b* provided on the outside of the inclination portion 38a (on the side of the integral molding portion 34), it is possible to stably hold the filter 33 by placing the filter 33 on the flat portion 38*b*. Then, in this state, the filter 33 is sandwiched between the cartridge casing 32 and the ink supply needle 31 (a sandwiching procedure). In the sandwiching procedure, the filter 33 is curved by the inclination portion 38*a* so as to protrude toward the ink supply needle 31. Further, when the filter 33 is attached while the cartridge casing 32 is inclined, the filter 33 is sandwiched between the cartridge casing 32 and the ink supply needle 31 while suctioning the filter.

Subsequently, the cartridge casing 32 and the ink supply needle 31 sandwiching the filter 33 are held by a mold, a space is formed between the mold, the surface of the cartridge casing 32, and the inner surface of the wall portion 43, a heated resin is injected into the space, and then the resin is cooled to be solidified, thereby forming the integral molding portion 34 (refer to FIG. 4) (an integral molding procedure). In the embodiment, when the integral molding portion 34 is formed, a force is applied to the filter 33 due to a difference in the linear expansion coefficient between the cartridge casing 32 and the ink supply needle 31 or a thermal contraction of the resin forming the integral molding portion 34, so that the filter 33 further protrudes toward the ink supply needle 31. That is, the filter 33 protruding by the inclination portion 38*a* further protrudes toward the ink supply needle 31 due to the contraction, and as shown in FIG. 4, the filter 33 is formed in a curved surface shape that protrudes toward the ink supply needle 31. Accordingly, it is possible to prevent the filter 33 from being deformed toward the inner wall surface 96 of the cartridge casing 32, and to suppress the bubble discharging performance from being degraded during the bubble discharging operation. That is, in the embodiment, since the filter 33 protrudes toward the ink supply needle 31 in a convex shape by providing the inclination portion 38*a*, a stress is applied to the filter 33 so that the filter 33 further protrudes toward the ink supply needle 31. Accordingly, since the distance between the filter 33 and the inner wall surface 96 of the cartridge casing 32 increases as shown in FIG. 4, it is possible to further prevent a degradation of the bubble discharging performance caused when the filter 33 adheres to the inner wall surface 96 of the cartridge casing 32 or the channel is blocked by the deformed filter 33 during the bubble discharging operation.

Subsequently, the head body 220 is provided in the supply member 30 via a head casing 230 (an installation procedure), and a cover head 240 is attached so as to cover the head body 220, thereby forming the printing head 11 (refer to FIG. 2).

Figure 6:
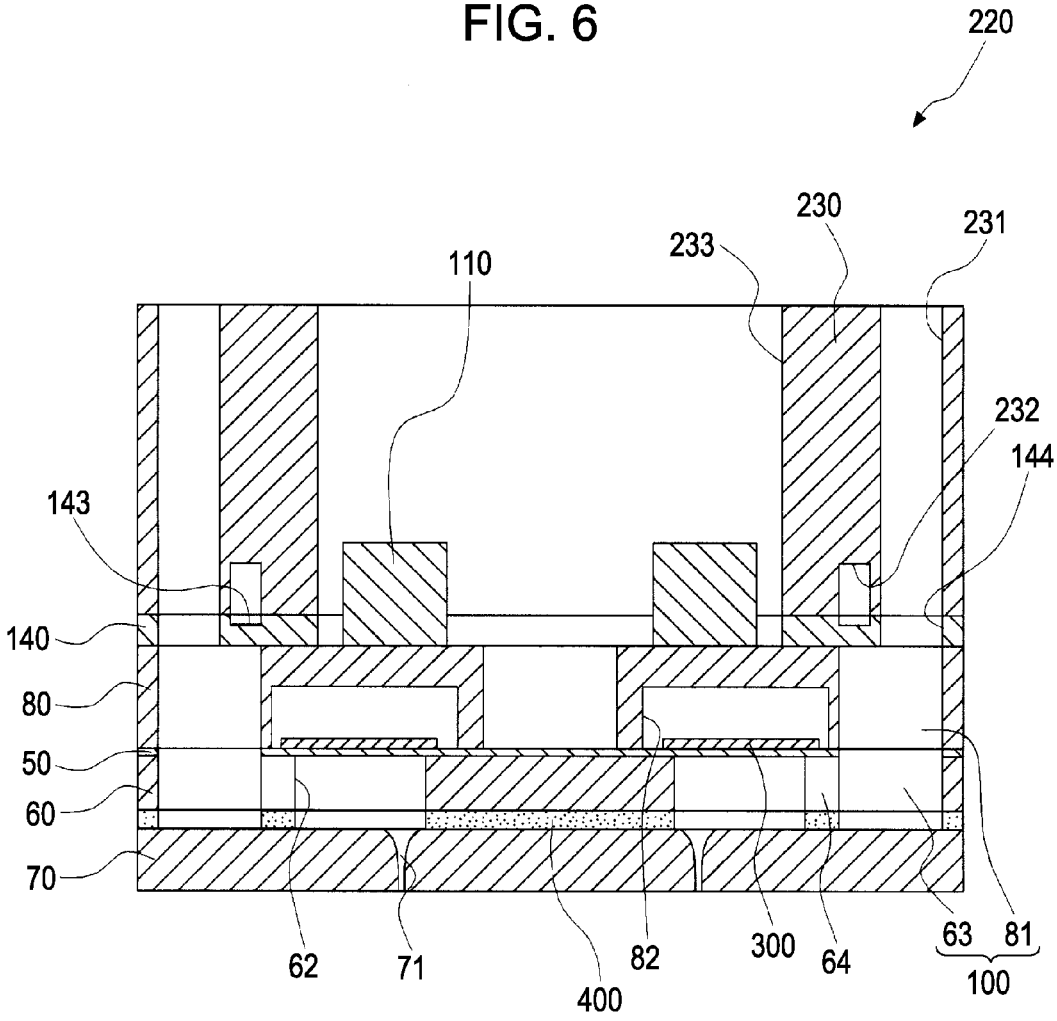
FIG. 6 is a cross-sectional view illustrating a head body according to the first embodiment.

The head body 220 is provided on the opposite side of the ink cartridge 13 in the supply member 30. Here, the head body 220 will be described with reference to FIGS. 5 and 6. Further, FIG. 5 is an exploded perspective view illustrating a head body, and FIG. 6 is a cross-sectional view illustrating the head body.

As shown in the drawings, a channel formation substrate 60 constituting the head body 220 is formed as a silicon single crystal substrate in the embodiment, and one surface thereof is provided with an elastic film 50 formed of silicon dioxide. Two rows of pressure generating chambers 62, defined by plural partition walls, are formed in parallel in the channel formation substrate 60 in the width direction by performing an anisotropic etching thereon from the other surface thereof. Further, a communication portion 63 is formed on the outside of each row of the pressure generating chambers 62 in the longitudinal direction so as to communicate with a reservoir portion 81 formed in a reservoir formation substrate 80 to be described later and to constitute a reservoir 100 serving as a common ink chamber common to each pressure generating chamber 62. Further, the communication portion 63 communicates with one longitudinal end portion of each pressure generating chamber 62 via a supply path 64. That is, in the embodiment, the pressure generating chamber 62, the communication portion 63, and the supply path 64 are provided as a liquid channel formed in the channel formation substrate 60.

Further, a nozzle plate 70 having nozzle openings 71 formed therein is fixed to an opening surface side of the channel formation substrate 60 via an adhesive 400. Specifically, plural nozzle plates 70 are provided so as to correspond to the plural head bodies 220. Each nozzle plate 70 has an area slightly wider than that of a nozzle opening portion 241 of the cover head 240 to be described later in detail, and is fixed to an area overlapping with the cover head 240 via adhesive or the like. The nozzle openings 71 of the nozzle plate 70 are perforated at positions respectively communicating with the opposite sides of the supply paths 64 of the pressure generating chambers 62. In the embodiment, since two rows of the pressure generating chambers 62 are provided in the channel formation substrate 60, two nozzle rows 71A having the nozzle openings 71 arranged in parallel are provided in one head body 220. Then, in the embodiment, the surface where the nozzle openings 71 of the nozzle plate 70 are opened is used as a liquid ejecting surface. Examples of the nozzle plate 70 include a silicon single crystal substrate or a metallic substrate such as stainless steel (SUS).

On the other hand, each piezoelectric elements 300 is formed on the opposite side of the opening surface of the channel formation substrate 60 by sequentially laminating a first electrode formed of metal, a piezoelectric layer formed of a piezoelectric material such as lead zirconate titanate (PZT), and a second electrode formed of metal on the elastic film 50.

The reservoir formation substrate 80 having the reservoir portion 81 forming at least a part of the reservoir 100 is bonded to the channel formation substrate 60 having the piezoelectric element 300 formed thereon. In the embodiment, the reservoir portion 81 is formed across the width direction of the pressure generating chamber 62 while perforating the reservoir formation substrate 80 in the thickness direction, and communicates with the communication portion 63 of the channel formation substrate 60 as described above, thereby forming the reservoir 100 serving as a common ink chamber common to each pressure generating chamber 62.

In addition, an area facing the piezoelectric element 300 in the reservoir formation substrate 80 is provided with a piezoelectric element holding portion 82 which has a space to the degree that the movement of the piezoelectric element 300 is not disturbed.

Further, a driving circuit 110 including a semiconductor integrated circuit (IC) for driving each piezoelectric element 300 is provided on the reservoir formation substrate 80. Each terminal of the driving circuit 110 is connected to a wiring drawn from an individual electrode of each piezoelectric element 300 via a bonding wire (not shown) or the like. Then, each terminal of the driving circuit 110 is connected to an external device via an external wiring 111 such as a flexible printed circuit board (FPC), and receives various signals such as a printing signal from the external device via the external wiring 111.

In addition, a compliance substrate 140 is bonded to the reservoir formation substrate 80. An area facing the reservoir 100 in the compliance substrate 140 is provided with an ink introduction opening 144 which perforates the area in the thickness direction and supplies ink to the reservoir 100. Further, an area other than the ink introduction opening 144 of the area facing the reservoir 100 in the compliance substrate 140 is formed as a flexible portion 143 which is formed to be thin in the thickness direction, and the reservoir 100 is sealed by the flexible portion 143. The flexible portion 143 applies compliance to the inside of the reservoir 100.

Further, the head casing 230 is fixed onto the compliance substrate 140.

The head casing 230 includes an ink supply communication path 231 which communicates with the ink introduction opening 144 and the ink supply path of the supply member 30 so as to supply the ink from the supply member 30 to the ink introduction opening 144. In the head casing 230, an area facing the flexible portion 143 in the compliance substrate 140 is provided with a groove portion 232, and the bending of the flexible portion 143 is appropriately performed therein. Further, in the head casing 230, an area facing the driving circuit 110 provided on the reservoir formation substrate 80 is provided with a driving circuit holding portion 233 which perforates the area in the thickness direction. The external wiring 111 is connected to the driving circuit 110 while being inserted through the driving circuit holding portion 233.

A pin insertion hole 234 is provided at two positions of each member constituting the head body 220 so as to insert a pin, positioning each member during an assembling operation, therethrough. Then, when the pin is inserted into the pin insertion hole 234 so as to determine the relative positions of the members and to bond them to each other, the head body 220 can be assembled as a single body.

Further, as shown in FIG. 2, the head body 220 held by the supply member 30 via the head casing 230 is relatively positioned and held by the cover head 240 which is formed in a box shape so as to cover the liquid ejection surfaces of five head bodies 220. The cover head 240 includes nozzle openings 241 which expose the nozzle openings 71 therefrom and a head bonding portion 242 which defines the nozzle opening portion 241 and is bonded to both end portions of the nozzle openings 71 forming at least the nozzle row 71A in the liquid ejection surface of the head body 220.

Furthermore, the side surface side of the liquid ejecting surface of the head body 220 in the cover head 240 is provided with a side wall portion 245 which extends so as to be curved along the outer peripheral edge portion of the liquid ejecting surface.

Likewise, since the head bonding portion 242 of the cover head 240 is bonded to the liquid ejecting surface of the head body 220, it is possible to reduce a step between the liquid ejecting surface and the cover head 240, and to prevent ink from staying in the liquid ejecting surface even when the liquid ejecting surface is wiped or suctioned. In addition, since the gap between the adjacent head bodies 220 is blocked by a bridge portion 244, it is possible to prevent the ink from entering the gap between the adjacent head bodies 220 and to prevent the piezoelectric element 300 or the driving circuit 110 from being degraded or broken by the ink. Further, since the liquid ejecting surface of the head body 220 and the cover head 240 are bonded to each other by the use of adhesive so that no gap is formed therebetween, it is possible to prevent the printing target medium S from entering the gap. Accordingly, it is possible to prevent a deformation of the cover head 240 and paper jams. Further, since the side wall portion 245 covers the outer peripheral edge portions of the plural head bodies 220, it is possible to reliably prevent the ink from wrapping around the side surface of the head body 220. Furthermore, since the cover head 240 is provided with the head bonding portion 242 bonded to the liquid ejecting surface of the head body 220, it is possible to very precisely position and bond the nozzle rows 71A of the plural head bodies 220 to the cover head 240.

As the cover head 240, for example, a metal material such as stainless steel may be exemplified, or a metal plate may be formed by press machining or molding. Further, when the cover head 240 is formed of a conductive metal material, the cover head may be grounded. Furthermore, the method of bonding the cover head 240 and the nozzle plate 70 to each other is not particularly limited, and for example, bonding the cover head 240 and the nozzle plate 70 may be bonded to each other using thermosetting epoxy based adhesive or UV curable adhesive.

In the ink jet printing head 11 according to the embodiment, the ink is received from the ink cartridge 13 via the first ink supply path 91 and the second ink supply path 92, the ink is filled into the inside portion from the reservoir 100 to the nozzle opening 71 via the ink supply communication path 231 and the ink introduction opening 144, and then a voltage is applied to each piezoelectric element 300 corresponding to each pressure generating chamber 62 in response to the printing signal from the driving circuit 110 so as to bend the elastic film 50 and the piezoelectric element 300. As a result, the pressure inside each pressure generating chamber 62 becomes higher, so that an ink droplet is ejected from the nozzle opening 71.

Second Embodiment

Figure 7:
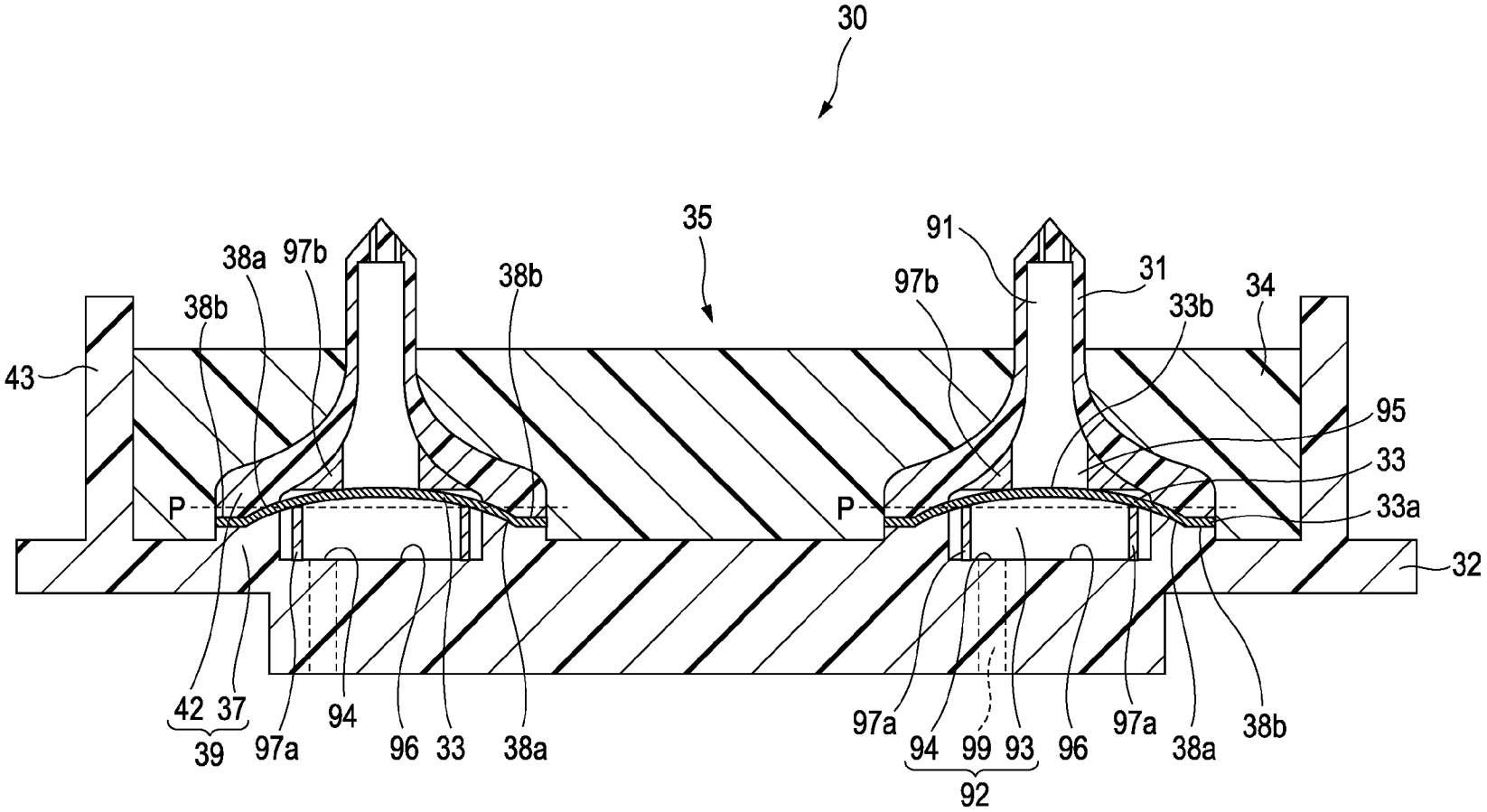
FIG. 7 is a cross-sectional view illustrating a cartridge casing according to a second embodiment.
Figure 8:
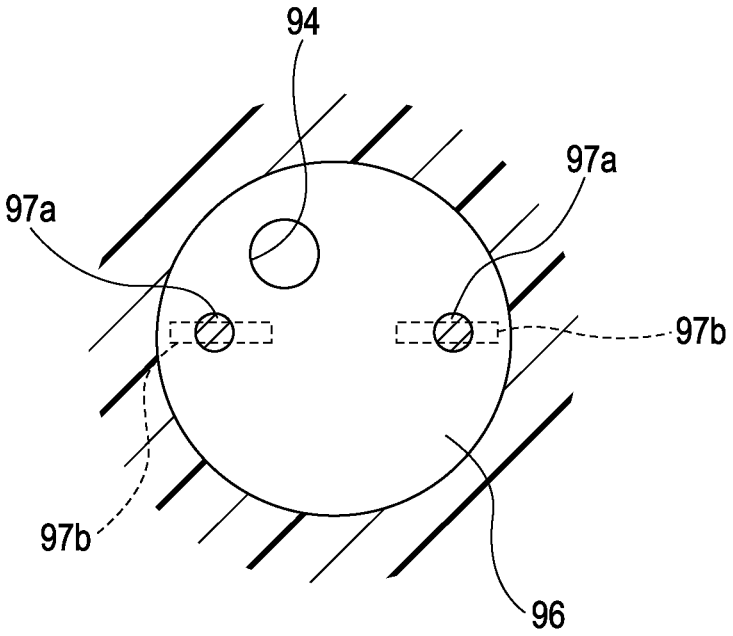
FIG. 8 is a cross-sectional view illustrating a supply member according to the second embodiment.

In the embodiment, the ink jet printing head 11 according to the first embodiment further includes protrusions (protrusion members 97*a* and regulation members 97*b*) which are formed in the first and second ink supply paths 91 and 92. Hereinafter, the embodiment will be described in detail with reference to FIGS. 7 and 8.

In the embodiment, the inner wall surface 96 of the cartridge casing 32 is provided with two protrusion members 97*a* protruding toward the ink supply needle 31 more than the bonding plane P. Each protrusion member 97*a* is a column-shaped protrusion, and supports the channel area 33*b* of the filter 33 from the downstream side thereof. By providing the protrusion member 97*a*, not only the inclination portion 38*a* but the channel area 33*b* of the filter 33 is lifted toward the ink supply needle 31 more than the bonding plane P by the protrusion member 97*a*, and the filter 33 is more reliably formed in a convex shape toward the ink supply needle 31. Likewise, since the inclination portion 38*a* and the protrusion member 97*a* are simultaneously used, the filter 33 reliably protrudes more than the bonding plane P. Accordingly, even when the flow amount of the ink is large, it is possible to reliably make the distance between the inner wall surface 96 and the peripheral portion of the channel area 33*b* of the filter 33 large. As a result, in the embodiment, it is possible to more reliably prevent the filter 33 from adhering to the inner wall surface 96 during the bubble discharging operation, and to suppress a degradation of the bubble discharging performance. Further, since it is possible to reliably make the distance between the inner wall surface 96 and the peripheral portion of the channel area 33*b* of the filter 33 large, bubbles hardly assemble between the filter 33 and the inner wall surface 96.

Further, since the filter 33 is supported by the protrusion members 97*a*, a gap may be formed between the filter 33 and the inner wall surface 96 at all times. Accordingly, at the time when the suction is performed from the nozzle opening during the bubble discharging operation, it is possible to reliably prevent the filter 33 from being pulled and adhering to the inner wall surface 96 or prevent the channel from being blocked by the deformation of the filter 33.

Specifically, the protrusion members 97*a* are provided while being distant from each other in the radial direction of the filter chamber 93 in the top view. Since the protrusion members are provided while being distant from each other in the radial direction, it is possible to effectively suppress the filter from being curved. Further, each protrusion member 97*a* is provided while being distant from the sandwiching portion 39. Since each protrusion member 97*a* is provided while being distant from the sandwiching portion 39, it is possible to ensure the flow of ink between the sandwiching portion 39 and the protrusion member 97*a*, and thus to suppress bubbles from assembling at a certain position due to the staying of the ink. For example, when the protrusion member is formed to be continuous to the sandwiching portion 39 differently from the embodiment, ink tends to stay between the protrusion members, so that bubbles tend to assemble therebetween.

Further, since the protrusion members 97*a* are provided with a predetermined gap therebetween, the flow of ink in the ink channel inside the cartridge casing 32 is not disturbed by the protrusion member 97*a*, and the flow rate thereof is not reduced. For example, when the protrusion members are continuously formed in the circumferential direction without making any gap therebetween differently from the embodiment, the ink stays at a certain position, so that bubbles tend to assemble at the position. Further, since the protrusion members 97*a* are disposed so as to follow the shape of the ink channel, the flow of ink is not disturbed by the protrusion member 97*a*, and bubbles are suppressed from assembling at the vicinity of the protrusion member 97*a*. Furthermore, in the embodiment, the protrusion members 97*a* are provided without any bias so as to be symmetrical to each other with respect to the inner wall surface 96. Likewise, since the protrusion members 97*a* are provided without any bias so as to be symmetrical to each other with respect to the inner wall surface 96, it is possible to allow the entire filter 33 to protrude uniformly, and thus to further suppress the filter 33 from adhering to the inner wall surface 96 during the bubble discharging operation or to prevent bubbles from assembling at a certain position. Then, since the protrusion members 97*a* are provided while being distant from each other in the circumferential direction, it is possible to prevent a part of the filter 33 from being depressed toward the inner wall surface 96. Accordingly, it is possible to further suppress the filter 33 from adhering to the inner wall surface 96 during the bubble discharging operation or to prevent bubbles from assembling at a certain position.

Further, in the embodiment, even the inner wall surface on the side of the ink supply needle 31 is provided with the regulation members 97*b* which protrude toward the filter chamber 93 so as to face the above-described protrusion members 97*a* and to regulate the filter 33 from being deformed in a convex shape. Each regulation member 97*b* is a rib-shaped member, and the excessive convex-shaped deformation of the filter 33 is regulated by the regulation members 97*b*. When the convex-shaped deformation of the filter 33 becomes excessively large, the filter 33 adheres to the ink supply needle 31 and the flow rate of ink may not be ensured. Also, the strength of the filter 33 is degraded.

Likewise, in the embodiment, since the protrusion members 97*a* are provided, compared with the first embodiment, it is possible to more reliably prevent the filter 33 from being pulled and adhered to the inner wall surface 96 during the bubble discharging operation and to regulate the deformation of the filter 33 by the regulation members 97*b* when the suction is performed from the nozzle opening during the bubble discharging operation.

While the exemplary embodiments of the invention have been described, the basic configuration of the invention is not limited thereto. In the second embodiment, two protrusion members 97*a* are provided for each inner wall surface 96, but the number thereof is not limited to the embodiment. The number or the shape thereof is not limited so long as plural protrusion members 97*a* are provided so that the filter 33 protrudes toward the ink supply needle 31 and the flow of ink is not disturbed by the protrusion members. For example, in the embodiment, the protrusion member 97*a* is formed in a column shape, but may be formed in a wall surface shape. Further, in the second embodiment, the protrusion member 97*a* protrudes toward the ink supply needle 31 more than the bonding plane P, but the invention is not limited thereto. That is, the protrusion member may not protrude toward the ink supply needle 31 more than the bonding plane P. This is because the filter 33 is prevented from adhering to the inner wall surface 96 during the bubble discharging operation even when the protrusion member 97*a* does not protrude past the bonding plane P. However, when the protrusion member protrudes past the bonding plane P as in the embodiment, it is possible to further prevent the filter from adhering to the inner wall surface 96. For this reason, the configuration of the embodiment is desirable.

Also, the number or the shape of the regulation member 97*b* is not limited so long as the deformation of the filter 33 can be regulated.

Further, in the second embodiment, the protrusion member 97*a* and the regulation member 97*b* are provided, but any one of them may be provided.

In the above-described embodiments, the ink cartridge 13 is directly connected to the ink supply needle 31 so as to be attachable thereto or detachable therefrom, but the invention is not limited thereto. For example, a supply tube formed as a flexible tube (not shown) may be disposed between the ink cartridge 13 and the ink supply needle 31 so as to supply the ink from the ink cartridge, disposed distant from the ink supply needle 31, to the ink supply needle 31.

In the above-described embodiments, the filter 33 is sandwiched between the ink supply needle 31 and the cartridge casing 32, and they are integrally molded and bonded to each other by the integral molding portion 34. However, the invention is not limited thereto. For example, the filter 33 may be welded to the cartridge casing 32, and the cartridge casing 32 having the filter 33 welded thereto and the ink supply needle 31 may be integrally molded and bonded to each other by the integral molding portion 34. Even at the time when the filter 33 is welded to the cartridge casing 32, the filter 33 is deformed and twisted by heat or the like. However, in the invention, since the inclination portion 38*a* is provided, it is possible to prevent the filter 33 from adhering to the inner wall surface 96 during the bubble discharging operation or to prevent the channel from being blocked by the deformation of the filter 33 even when the filter 33 is deformed at the time of welding the filter 33. Accordingly, it is possible to prevent a degradation of the bubble discharging performance.

In the above-described embodiments, the filter 33 is formed in a sheet shape by woven metals, but the invention is not limited thereto. For example, the sheet shape may be formed by perforating a metal sheet or may be formed of a resin having minute holes.

In the above-described embodiments, the ink cartridge 13 as a liquid storing member is attachable to or detachable from the supply member 30, but the invention is not particularly limited thereto. For example, an ink tank or the like as a liquid storing member may be provided at a position different from the printing head 11, and the liquid storing member and the printing head 11 may be connected to each other via a supply tube such as a tube. That is, in the above-described embodiments, the needle-shaped ink supply needle 31 is exemplified as the first supply member, but the shape of the first supply member is not limited to the needle shape.

In the above-described embodiments, a configuration has been exemplified in which one head body 220 is provided for two liquid supply paths, but plural head bodies may be provided for each color of ink. In this case, each liquid supply path communicates with each head body. That is, each liquid supply path may be provided so as to communicate with each nozzle row having plural nozzle openings arranged in each head body. Of course, the liquid supply path may not communicate with each nozzle row, and one liquid supply path may communicate with plural nozzle rows. Also, one nozzle row may be divided into two so that liquid supply paths communicate with the divided rows. That is, the liquid supply path may communicate with the nozzle opening group having plural nozzle openings.

In the above-described embodiments, the invention has been described by exemplifying the ink jet printing head 11 ejecting ink droplets, but the invention is contrived for the general liquid ejecting head in a broad sense. Examples of the liquid ejecting head include a printing head which is used in an image forming apparatus such as a printer, a color material ejecting head which is used to manufacture a color filter of a liquid crystal display or the like, an electrode material ejecting head which is used to form an electrode of an organic EL display, an FED (Field Emission Display), or the like, and a biological organic material ejecting head which is used to manufacture a biochip.

What is claimed is:

1. A liquid ejecting head comprising:

a head body which ejects a liquid supplied from a liquid storing member via a liquid supply path;

a first supply member which is provided with a first liquid supply path forming a part of the liquid supply path;

a second supply member which is provided with a second liquid supply path communicating with the first liquid supply path and forming a part of the liquid supply path, and which supplies the liquid to the head body;

a filter which is sandwiched between the first and second liquid supply paths; and an integral molding portion which integrally molds and bonds the first and second supply members to each other, wherein a sandwiching portion including the first and second supply members and sandwiching the filter includes an inclination portion that is inclined to the downstream side so as to face the outside of the liquid supply path, wherein the portion of the filter sandwiched at the inclination portion is inclined in accordance with the inclination portion.

2. The liquid ejecting head according to claim 1, wherein the filter includes a channel area and a sandwiching area sandwiched by the first and second supply members, and wherein an inner wall surface facing the channel area in the second liquid supply path is provided with a protrusion member that protrudes toward the first liquid supply path.

3. The liquid ejecting head according to claim 2, wherein the protrusion member protrudes toward the first liquid supply path past a surface sandwiching the filter.

4. The liquid ejecting head according to claim 1, wherein an inner wall surface facing the channel area in the first liquid supply path is provided with a regulation member that protrudes toward the filter.

5. A liquid ejecting apparatus comprising:

a liquid ejecting head, the liquid ejecting head comprising:

a head body which ejects a liquid supplied from a liquid storing member via a liquid supply path;

a first supply member which is provided with a first liquid supply path forming a part of the liquid supply path;

a second supply member which is provided with a second liquid supply path communicating with the first liquid supply path and forming a part of the liquid supply path, and which supplies the liquid to the head body;

a filter which is sandwiched between the first and second liquid supply paths; and an integral molding portion which integrally molds and bonds the first and second supply members to each other, wherein a sandwiching portion including the first and second supply members and sandwiching the filter includes an inclination portion that is inclined to the downstream side so as to face the outside of the liquid supply path, wherein the portion of the filter sandwiched at the inclination portion is inclined in accordance with the inclination portion.

6. The liquid ejecting apparatus according to claim 5, wherein the filter includes a channel area and a sandwiching area sandwiched by the first and second supply members, and wherein an inner wall surface facing the channel area in the second liquid supply path is provided with a protrusion member that protrudes toward the first liquid supply path.

7. The liquid ejecting apparatus according to claim 6, wherein the protrusion member protrudes toward the first liquid supply path past a surface sandwiching the filter.

8. The liquid ejecting apparatus according to claim 5, wherein an inner wall surface facing the channel area in the first liquid supply path is provided with a regulation member that protrudes toward the filter.

* * * * *